US006359614B1

(12) United States Patent
McVicar

(10) Patent No.: US 6,359,614 B1
(45) Date of Patent: Mar. 19, 2002

(54) TWIST LOCK/UNLOCK MECHANISM FOR GAMING DEVICE HANDLE

(75) Inventor: David McVicar, El Dorado, CA (US)

(73) Assignee: Logitech Europe, S.A., Romanuel-sur-Morges (CH)

( * ) Notice: Subject to any disclaimer, the term of this patent is extended or adjusted under 35 U.S.C. 154(b) by 0 days.

(21) Appl. No.: 09/309,243

(22) Filed: May 10, 1999

(51) Int. Cl.[7] ..... G09G 5/00

(52) U.S. Cl. ..... 345/161; 345/157; 463/38; 273/148 B

(58) Field of Search ..... 345/156–169; 273/148 B; 248/913; 200/6 A; 74/471 XY; 463/36–38; 340/20–22

(56) References Cited

U.S. PATENT DOCUMENTS 5,317,336 A * 5/1994 Hall ..... 345/164
5,790,101 A * 8/1998 Schoch et al. ..... 345/161
5,829,745 A * 11/1998 Houle ..... 273/148 B
5,868,620 A * 2/1999 Wada et al. ..... 463/38
6,050,897 A * 4/2000 Suzuki et al. ..... 463/37
6,059,660 A * 5/2000 Takada et al. ..... 463/38

* cited by examiner

*Primary Examiner*—Lun-Yi Lao
(74) *Attorney, Agent, or Firm*—Townsend and Townsend and Crew LLP

(57) ABSTRACT

An input device with an elongated handle that can be twisted. A twisting support is coupled to the handle, the twisting support allowing the handle to twist about its axis. A lock is provided for locking the handle at user discretion so that it will not twist about its axis.

8 Claims, 3 Drawing Sheets

TWIST LOCK/UNLOCK MECHANISM FOR GAMING DEVICE HANDLE

BACKGROUND OF THE INVENTION

The present invention relates to gaming device controllers, and in particular, joysticks incorporating a twist feature.

Video game software that requires a gaming input device such as a joystick often incorporate the ability to have a "twist axis" associated with the vertical axis of the device. These games, often flight simulators, use this rotation for rudder control. Other video games, such as motorcycle racing simulators, have no need for this additional feature and therefore do not support it. When a user is playing a video game that does not require "twist" this feature tends to be annoying by making the action harder to control.

SUMMARY OF THE INVENTION

The present invention provides an input device with an elongated handle that can be twisted. A twisting support is coupled to the handle, the twisting support allowing the handle to twist about its axis. A lock is provided for locking the handle at user discretion so that it will not twist about its axis. Thus, a user can use the same joystick for applications requiring twisting and for applications where twisting is not desired.

In one embodiment, the device is formed with an internal pipe and an external handle, with the external handle twisting about the internal pipe against the force of a spring wrapped around the internal pipe. The internal pipe has a slot which is engaged by a moveable element connected to the handle. The moveable element can be a bar with a curved section that rotates into the slot to lock the handle and prevent it from twisting, and rotates out of the slot to allow twisting to occur.

In an alternate embodiment, an internal pipe includes at least one peg extending outward which engages a slot in the handle. The handle can be moved so that the peg freely rotates within the slot, allowing the handle to twist, or it can be moved to where the slot is narrowed to hold the peg and restrain movement of the handle about its axis.

For a further understanding of the nature and advantages of the invention, reference should be made to the following description taken in conjunction with the accompanying drawings.

DESCRIPTION OF THE SPECIFIC EMBODIMENTS

Figure 1:
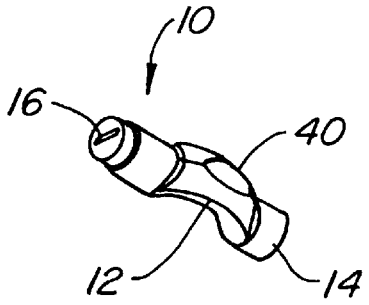
FIG. 1 is a perspective view the locking shaft of one embodiment of the invention.

FIG. 1 illustrates an asymmetric shaft 10. The shaft has a central section 12 that is curved. An end 14 of the shaft inserts into a recess in the handle, with an end 16 engaging a hole in the handle and providing a slot for a screwdriver to turn the shaft.

Figure 2:
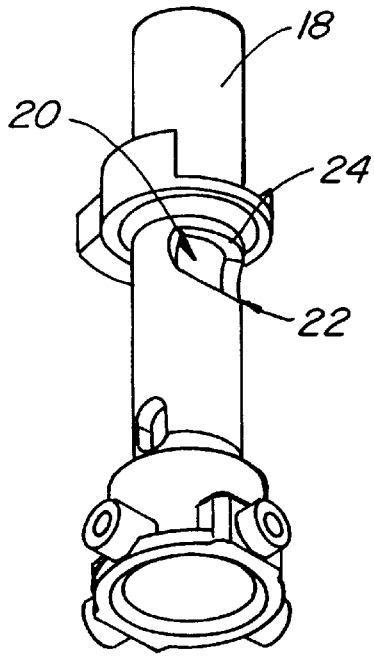
FIG. 2 is a perspective view of the internal pipe showing the slot engaged by the shaft of FIG. 1.

FIG. 2 shows an internal pipe 18 for the joystick having a slot 20 for engaging shaft 10. Slot 20 is designed to have a lower portion 22 which allows the curved section 12 to rotate into it from the bottom. An upper section 24 of the slot is flat, to block movement of the shaft so that it does not turn too far upon locking, and become unlocked again.

Figure 3:
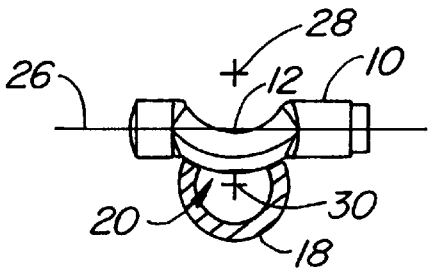
FIG. 3 is a top view of the shaft and slot illustrating a locked position.

FIG. 3 illustrates the locked position of shaft 10. As can be seen, center portion 12 is rotated into slot 20 of pipe 18. It rotates about its central axis 26 so that the center line of the radius that creates the curved section (28) is offset and parallel to the center line of the pipe (30).

Figure 4:
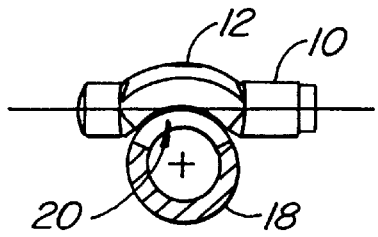
FIG. 4 is a top view of the shaft and slot, illustrating an unlocked position.

FIG. 4 shows the unlocked position, in which shaft 10 is rotated such that curved portion 12 is outside of slot 20. As can be seen, the interior radius of curved section 12 allows pipe 18 to twist without interference. The inside radius is slightly larger than the radius of the outside of the pipe. The shaft rotates 180 degrees between the locked and unlocked positions. The axis of the shaft is perpendicular to and offset from the axis of the pipe, which is also the axis of twist.

Figure 5:
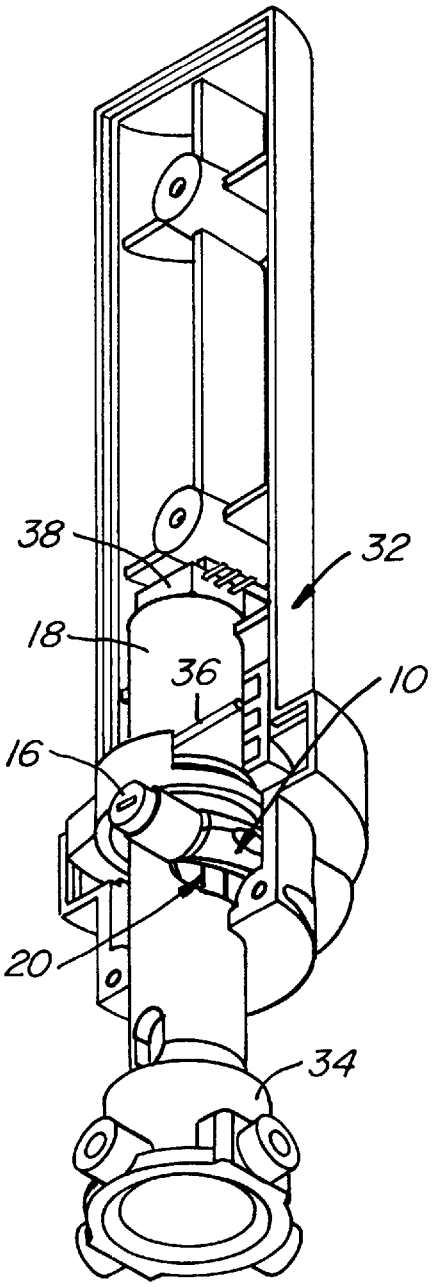
FIG. 5 is a cutaway, perspective view of the pipe and handle as assembled, illustrating the unlocked position.

FIG. 5 illustrates one of the handle halves 32 wrapped around internal pipe 18 with shaft 10 rotated into the unlocked position. The pipe is connected to a base 34 which is inserted into a gimbal mechanism for allowing normal rotational movement of a joystick. Twisting of the joystick handle 32 about pipe 18 is done against the force of a spring 36, which is wrapped around the internal pipe with ends engaging the handle 32.

Figure 6:
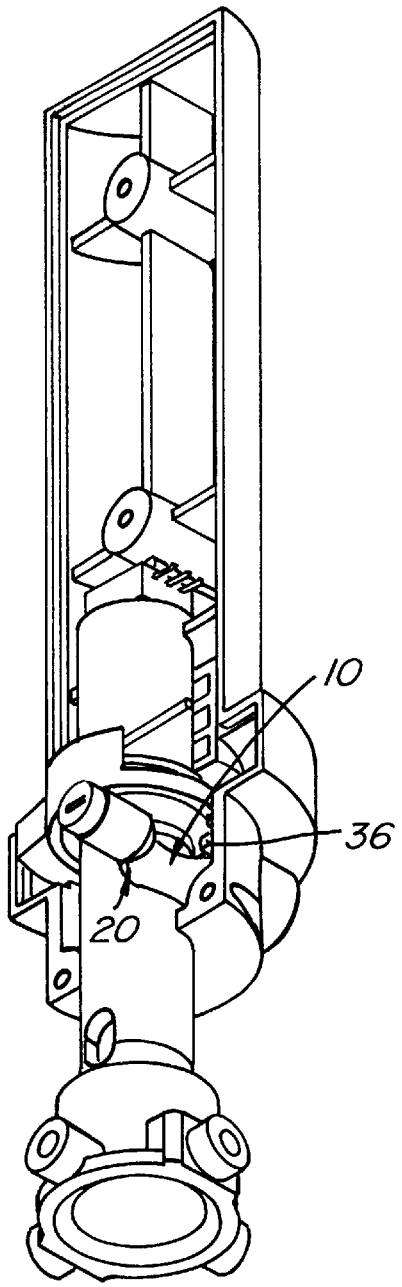
FIG. 6 is a cutaway, perspective view of the embodiment of FIG. 5, illustrating the shaft in the locked position.

FIG. 6 illustrates the embodiment of FIG. 5 with shaft 10 rotated into the locked position in slot 20. Also visible in FIG. 6 is an element 36 in the joystick handle which prevents shaft 20 from rotating too far upward in the unlocked position.

The twisting movement is detected by a potentiometer 38 mounted in the joystick handle 32, and having a wiper (not visible) attached to the top of pipe 18 to move when pipe 18 twists.

Returning to FIG. 1, a feature 40 may be incorporated into the shaft to retain the shaft in a locked position once it is fully rotated. This feature may be, for example, an eliptical bump which deforms and snaps into a corresponding indented feature in pipe 18 to hold it in the locked position. A similar feature is provided in handle 32 to secure the shaft in the unlocked position.

In one embodiment, the outside of handle 32 has molded arrows which are exposed when end 16 of the shaft is rotated, to show the direction of rotation to the other position. These arrows aid the user by showing which way to turn the screwdriver to move to the other position.

Figure 7:
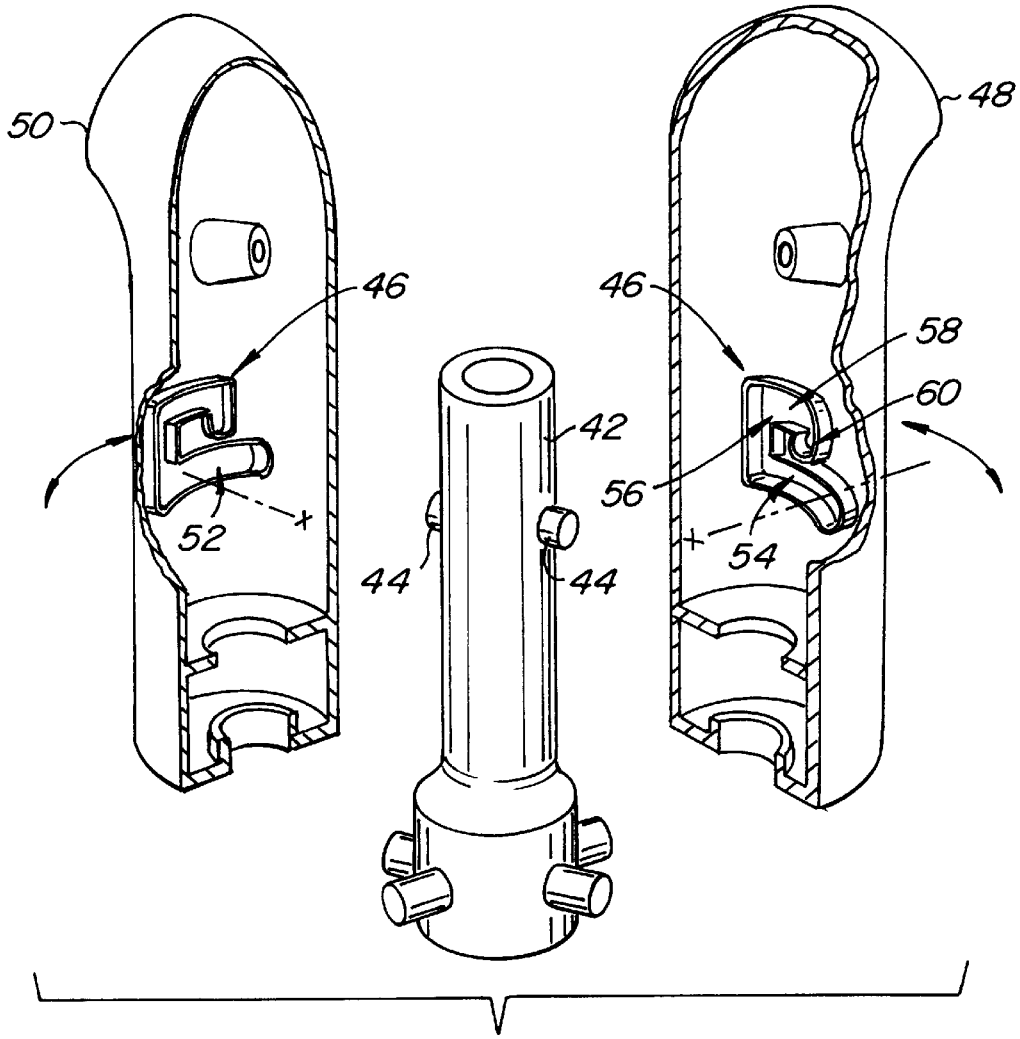
FIG. 7 is a cutaway, perspective, expanded view of a second embodiment of the invention using pegs on the internal pipe.

FIG. 7 illustrates an alternate embodiment having an internal pipe 42 with two protruding pegs 44. These pegs engage slots 46 molded into the handle halves 48 and 50. When twisting is desired, the pegs engage portions 52 and 54 of the slots, allowing free movement. To lock the device, the user would twist the handle in one direction, push the handle down so that the pegs rise in a vertical portion 56 of the slot. Then, the user would twist to the side so that the peg moves sideways in portion 58 of the slot. The handle is then pulled up so that the peg comes to rest in restrained portion 60 of the slot. In an alternate embodiment, the slots are in the pipe, and the pegs in the handle, and the user motions are the mirror image of those described above (the user initially pulls up, instead of down, etc.) An initial user upward movement may be more desirable, because the user normal operation grasp would put pressure downward, and thus might cause undesired movement in the slot during game play.

In one embodiment, springs may be mounted on the bottom of the handle to push it upward to hold it into the locked position once it is moved there. The restraind portion 60 may also have a narrow opening so the peg has to deform it slightly to enter, and would be held in place without the need for a spring on the bottom of the handle. This form of lock/unlock would require no external tools (a screwdriver) and could be accomplished "on the fly" during a game if so desired.

The invention thus provides the user with a choice as to activating or deactivating twist. The user can lock the handle to prevent it from twisting for those games that do not require it, and can unlock the handle to allow twist for games that do require it.

As will be understood by those of skill in the art, the present invention may be embodied in other specific forms without departing from the essential characteristics thereof. For example, the pegs of FIG. 7 could be on the handle, with the slots in the pipe. Alternately, the slot configuration of FIG. 7 could be inverted, so the user initially pulls up to adjust. Alternately, different shapes for the peg or shaft could be used to engage different shapes of a slot or recess in another portion of a joystick device. Alternately, a clamping mechanism could be used, similar to the releasable clasp on a wristwatch band or a hose clamp, which could tighten around the pipe in a locked position, and have a lever which loosens it in the unlocked position. Alternately, a joystick structure which did not use the internal pipe and handle could be provided with the handle instead rotating on its base, for example. Accordingly, the foregoing disclosure is intended to be illustrative, but not limiting, of the scope of the invention which is set forth in the following claims.

What is claimed is:

1. An input device comprising:

an elongated handle;

a twisting support coupled to said handle, said twisting support allowing said handle to twist about its axis; and a lock for locking said handle at user discretion so that it will not twist about its axis.

2. The device of claim 1 wherein said twisting support comprises a pipe internal to said elongated handle.

3. The device of claim 2 wherein said pipe includes a slot, and further comprising a movable element connected to said elongated handle for movement into said pipe to lock said handle.

4. The device of claim 3 wherein said movable element comprises an asymmetric shaft having a curved section with an inside radius larger than the radius of said pipe, said shaft being rotatable to move said curved section into said slot.

5. The device of claim 4 wherein said slot is configured to allow rotation of said shaft into said slot in only one direction, blocking an opposite direction.

6. The device of claim 4 wherein said handle is configured to allow rotation of said shaft in only one direction, blocking an opposite direction.

7. An input device comprising:

an elongated handle;

a twisting support coupled to said handle, said twisting support allowing said handle to twist about its axis, wherein said twisting support comprises a pipe internal to said elongated handle;

a lock for locking said handle so that it will not twist about its axis;

at least one peg extending out from said pipe; and a slot in said handle positioned to engage said handle, said handle being movable to position said peg at a portion of said slot that will restrain twisting movement of said handle.

8. An input device comprising:

an elongated handle;

a pipe internal to said handle, said pipe allowing said handle to twist about its axis;

a slot in said pipe; and an asymmetric shaft for locking said handle so that it will not twist about its axis, said asymmetric shaft having a curved section with an inside radius larger than the radius of said pipe, said shaft being rotatable to move said curved section into said slot.

* * * * *